US006135503A

United States Patent [19]

Lob et al.

[11] Patent Number: 6,135,503

[45] Date of Patent: Oct. 24, 2000

[54] IDENTIFICATION DOCUMENT

[75] Inventors: Erwin Lob, Munich; Gunther Endres, Passau; Josef Riedl, Attenkirchen; Joseph Lass, Munich, all of Germany

[73] Assignee: Giesecke & Devrient GmbH, Germany

[21] Appl. No.: 09/193,738

[22] Filed: Nov. 17, 1998

[30] Foreign Application Priority Data

| | | | |
|---|---|---|---|
| Nov. 21, 1997 | [DE] | Germany | 197 51 704 |
| Mar. 31, 1998 | [DE] | Germany | 198 14 420 |

[51] Int. Cl.[7] ..... B42D 15/00

[52] U.S. Cl. ..... 283/63.1; 281/21.1; 281/27; 283/74; 283/109; 283/900; 412/28; 412/35

[58] Field of Search ..... 283/75, 77, 74, 283/78, 76, 107, 109, 900, 904, 63.1; 281/21.1, 26, 27; 412/28, 35

[56] References Cited

U.S. PATENT DOCUMENTS

| | | | |
|---|---|---|---|
| 4,441,739 | 4/1984 | Cluff et al. | 283/63.1 |
| 4,534,581 | 8/1985 | Engh | 283/63.1 |
| 4,911,478 | 3/1990 | Oshikoshi et al. | 283/74 |
| 4,928,996 | 5/1990 | Oshikoshi et al. | 283/74 |
| 5,211,424 | 5/1993 | Bliss | 281/15.1 |
| 5,376,205 | 12/1994 | Drake | 283/63.1 |
| 5,897,144 | 4/1999 | Uno | 283/74 |

FOREIGN PATENT DOCUMENTS

| | | |
|---|---|---|
| 0 364 730 | 4/1990 | European Pat. Off. . |
| 0 847 873 A1 | 6/1998 | European Pat. Off. . |
| WO 98/19870 | 5/1988 | WIPO . |

*Primary Examiner*—Andrea L. Pitts
*Assistant Examiner*—Monica S. Carter
*Attorney, Agent, or Firm*—Bacon & Thomas PLLC

[57] ABSTRACT

The invention relates to an identification document, such as a passport or the like, which consists of a plurality of sheets bound into a book at a seam. At least one of the sheets forms a data sheet provided with information and consisting at least of two layers, at least one of the layers being transparent. The format of the layers is selected so that they protrude beyond the area of the seam thereby ensuring a connection of the data sheet with the other sheets of the identification document in the area of the seam. The layers are connected into an inseparable laminate in the area of the information but do not stick together in the area of the seam.

28 Claims, 3 Drawing Sheets

IDENTIFICATION DOCUMENT

BACKGROUND OF THE INVENTION

1. Field of the Invention

This invention relates to an identification document, such as a passport or the like, consisting of a plurality of sheets which are bound into a book at a seam and at least one sheet of which forms a data sheet provided with information and consisting at least of two layers, at least one of the layers being transparent and the format of the layers being selected so that they protrude beyond the area of the seam thereby ensuring a connection of the data sheet with the other sheets of the identification document in the area of the seam, and to a method for producing such an identification document.

2. Description of the Related Art

Passports usually have the form of a booklet consisting of a linen or plastic cover and a plurality of paper sheets. To increase forgery-proofness, one page of the passport which bears the personal data such as name, date of birth, photo, signature, etc., is usually provided with a transparent foil structure partly printed on the inner side so that these data are not directly accessible.

The production of such a passport is described for example in EP 0 364 730 A2. The paper or plastic sheet to be provided with the user-related data is first laminated with the transparent plastic foil. This laminated data sheet is then bound into a book with the other non-laminated sheets, the format of the data sheet being selected so that it protrudes beyond the seam of the passport, thus being bound into the passport so as to form an edge area reappearing at the end of the passport. In a last step, the data sheet is provided with the user-related data by means of a laser beam.

However, these known passport books have unsatisfactory bending properties for the data sheet in the area of the seam since cracks already start to form in the laminate at the seam of the book after a few bending cycles. When the laminated page is stressed a few more times, complete breakage finally takes place.

SUMMARY OF THE INVENTION

The invention is therefore based on the problem of proposing an identification document having improved bending properties and reducing the premature risk of breakage at the seam.

The invention is based on the idea of connecting the layer structure of the data sheet into an inseparable laminate only in the area of the information to be protected and ensuring that at least some of the layers of the data sheet fail to stick together in the area of the seam. That is, the paper and/or foil layers forming the data sheet are still present as single separate sheets or foils in the area of the seam.

In this way the personalized page is held in the seam by a plurality of single layers. Due to the flexibility of the single layers, the first cracks form only after a great number of bending cycles and are usually also present only in one of the layers. If one of the layers breaks, the data sheet is still held in the passport book by the other layers.

A further advantage of the invention is that the stiffness of the laminated page is greatly reduced in the area of the seam by the more flexible single foils, so that the passport book bursts open much less in the area of the inventive data sheet than known passport books having a completely laminated data sheet bound in.

One can further improve this effect through additional measures by subjecting the seam to an additional heat treatment. The projecting foils in the back area of the passport book are thereby bent so as to cling to the paper pages. An alternative possibility is to shorten the projecting foils to such an extent that they no longer transfer any forces to the passport cover. However, not all foil pages need be shortened in all cases. Depending on the thickness and stiffness of the foils used, it may suffice to shorten only some of the foil pages, i.e. thin out the foil bundle, in order to prevent fanning of the foil pages.

In its simplest embodiment, the data sheet can consist of an inlay layer and a transparent cover foil which both have the same format. The inlay layer preferably consists of an anti falsification paper which can have any authenticity features known for anti falsification papers, such as a watermark, steel intaglio printing or a security thread. Depending on the intended use and degree of security of the identification document, the inlay layer can also consist of a transparent or opaque plastic foil. It is also possible to compose the cover foil of a plurality of plastic foils.

According to a preferred embodiment, the data sheet consists of an inlay layer and two multilayer cover foils which are composed of single plastic foils. The inlay layer is disposed between the cover foils. Here, too, the inlay layer can consist of an anti falsification paper or of one or more plastic foils. The plastic foils used for the cover foils can consist of different plastic materials and/or contain different additives which influence the absorption of laser radiation for example. The layer thicknesses used are likewise variable. Both for the cover foils and for the inlay layer, however, one preferably uses plastic foils of polycarbonate (PC), glycol modified polyethyleneterephthalate (PETG) or "High Deflection Temperature" (HDT-PETG).

With the described multilayer structure, it is not absolutely necessary for all layers to be present as separate single layers in the area of the seam. Thus, some of the cover foil layers and/or inlay layers can also be connected into a laminate in the area of the seam. This can be useful for example if some of the layers used have an especially small thickness so that they are very unstable.

The inlay layer need not necessarily have the same format as the cover foils but can be selected to be smaller. It can be selected for example so that the inlay layer does not protrude into the area of the seam and is enclosed completely by the cover foils so that a so-called edge welding arises.

According to a special embodiment of the invention, the data sheet can have a format corresponding to the format of a double page of the identification document, so that not only an edge area of the data sheet appears at the end of the passport but a complete, likewise inscribed or inscribable personalized page is present. The inlay layer covered by the cover foil or foils can likewise have the same or a smaller format. However, the inlay layer can also consist of two single paper sheets each covered by the continuous cover foil, so that the inlay layers are held in the bound book only by the cover foil.

The number of plastic foils used for the single cover foils can likewise vary and need by no means be symmetrical. It is thus possible to compose one cover foil of two or more plastic foils and use only one plastic foil for the second cover foil. This can be useful for example if a special security element requiring a certain layer thickness is disposed on one side. This is the case with a so-called "laser tilt image" for example. This security element consists of a lens field and is combined with a picture motif disposed therebelow in such a way that different portions of the picture become visible upon a change of viewing angle. This picture motif can be produced with a laser through the lens structure (EP 0 219 012). This element requires a layer thickness at least corresponding to the focal length of the lenses.

The use of a plurality of plastic foils whose layer thickness adds up to the needed total thickness after lamination further has the advantage that the plastic foils can be adapted optimally in their properties to the particular intended use. With a laser tilt image the surface area in which the lenses are disposed must hardly absorb laser radiation, while the layer disposed in the focal plane of the lenses must be executed to be highly absorbent for radiation of the inscription laser. The plastic foils can therefore have additives absorbing laser radiation mixed in to different extents.

However, it must in any case be reliably ensured according to the invention that at least some of the layers are not interconnected in the area of the seam, which can be formed by a sewn-in thread or a gluing.

The identification document and the data sheet can of course have further security elements, such as optically variable diffraction structures (holograms, cinegrams, etc.) or the like.

Separation of the single layers in the area of the seam can be effected in different ways according to the invention. According to a preferred embodiment, connection-inhibiting printed layers are provided in the area of the seam, being applied to the single layers by screen printing or offset printing for example. During subsequent lamination of the data sheet, the layers only connect into an inseparable laminate in the non-printed area, while the single layers are still present in the area of the separation layers despite the action of heat and pressure.

Alternatively it is also possible to leave out the layers in the area of the seam during the laminating process so that they are not exposed to the heat and pressure parameters causing connection in the first place. If the single layers or some of the layers of the data sheet are interconnected by layers of adhesive, one can effect separation of the single layers in the area of the seam very simply by not coating this area with adhesive.

BRIEF DESCRIPTION OF THE DRAWINGS

Further embodiments and advantages of the invention will be explained in more detail with reference to the figures. It is pointed out that the representations are merely schematic and by no means true to scale, being intended only to illustrate the invention.

DETAILED DESCRIPTION OF THE PREFERRED EMBODIMENTS

Figure 1:
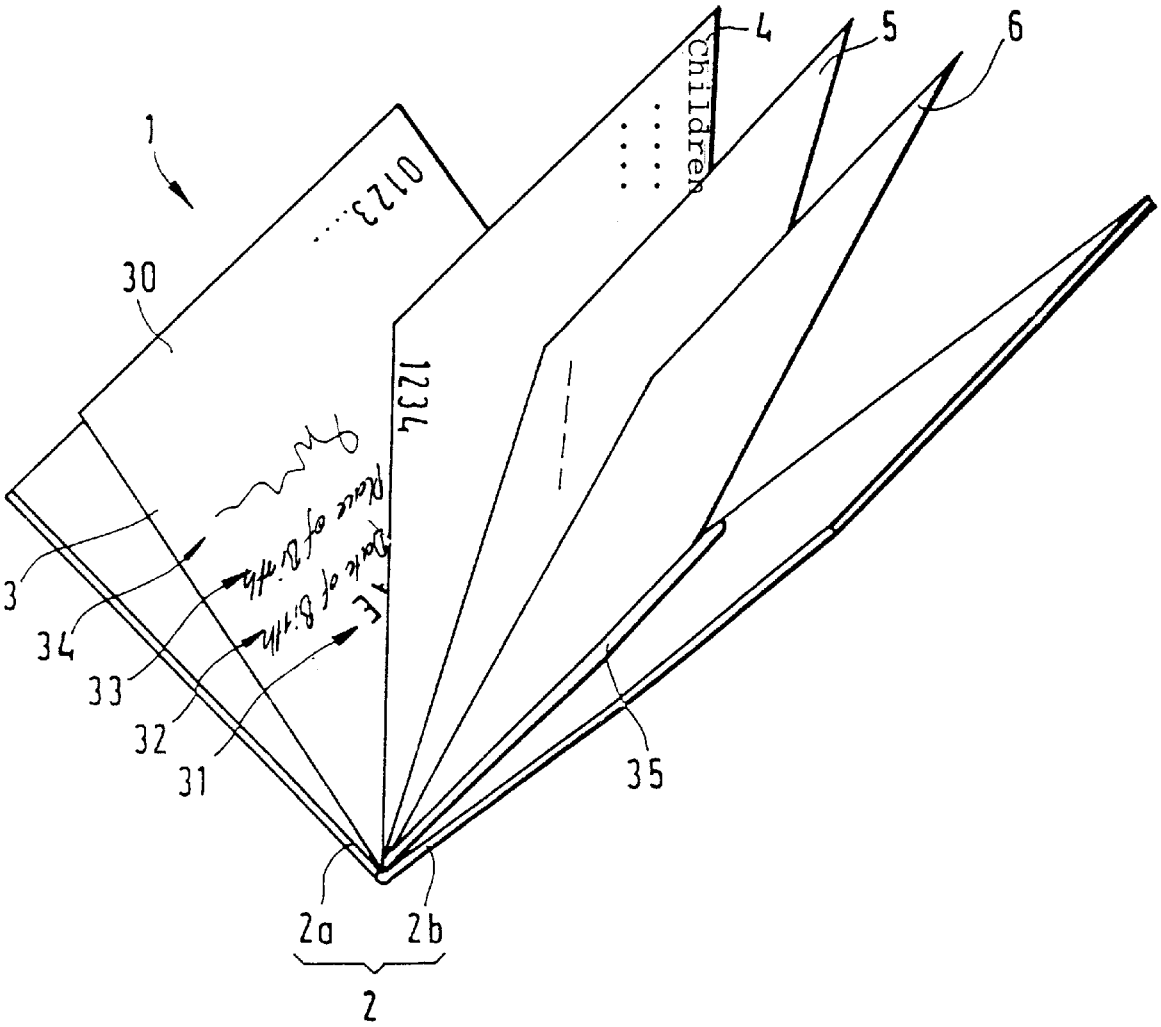
FIG. 1 shows a perspective view of an opened identification document.

FIG. 1 shows inventive identification document 1, such as a passport, which consists of plastic or linen cover 2 with front cover sheet 2*a* and back cover sheet 2*b*, personalized page or first data sheet 3, second data sheet 4, third data sheet 5 and empty sheet 6. Sheets 4, 5 and 6 and optionally further sheets not shown preferably consist of paper or another material with a surface quality allowing later entries (extensions, visas, etc.). Data sheet 4 bears for example information on the passport holder's children. In the lower area of data sheet 4 the passport number is additionally punched in. Personalized page or first data sheet 3 is the inventive data sheet and consists of two transparent cover foils enclosing therebetween a paper inlay provided with a security print and a watermark. In the present case, data sheet 3 has smooth surface area 30 in which machine-readable data lines are disposed. In addition, data sheet 3 bears name 31, date of birth 32, place of birth 33, and signature 34 of the holder of identification document 1. User-related data 31, 32, 33, 34, like the machine-readable data, are inscribed into completely laminated data sheet 3 by a laser. In area 30 the laser intensity can be controlled in such a way that a discoloration takes place only in the interior of the data sheet, i.e. the paper layer and plastic layer, while the outer plastic surface remains intact and thus smooth. Inscription with the user-related data, however, is preferably performed with somewhat higher laser power so that the surface of the cover foil is changed at the same time and a perceptible microrelief arises. Besides all these data, the identification document can of course be provided with further information and security elements depending on the intended use. For example the passport can have a photo of the passport holder likewise incorporated by a laser.

The format of data sheet 3 is selected so that it somewhat exceeds the passport size and is thus bound into the passport so as to form edge area 35 reappearing at the end of the passport. If edge area 35 is very short, the seam already takes up a lot of the bending motion itself and likewise reduces the risk of breakage.

Figure 2:
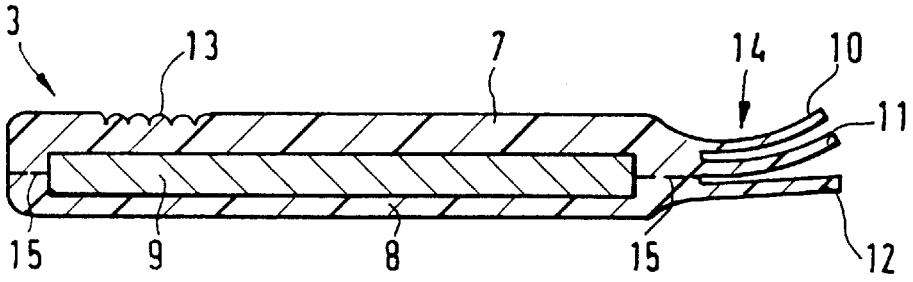
FIG. 2 shows a cross section of a laminated data sheet according to the invention for the identification document of FIG. 1.

FIG. 2 shows data sheet 3 in cross section. It consists of paper or plastic inlay 9 and two cover foils 7 and 8, cover foils 7, 8 having different layer thicknesses. Lens structure 13 is embossed into the surface of cover foil 7, forming a laser tilt image together with information located below the lens structure and not shown here. Cover foils 7, 8 and inlay 9 are interconnected in the area of the data to be protected in such a way that an undetachable compound arises. The format of data sheet 3 can be selected so that it is completely surrounded by foils 7 and 8, as shown in FIG. 2. In the area of arrow 14 there is the seam of the passport which can be realized by a sewn-in thread or by gluing of the single passport pages.

Cover foil 7 originally consists of two single plastic foils 10 and 11 (indicated by dash lining 15) which likewise coalesce into a unit during the laminating process. Foils 10 and 11 fail to stick together only in the area of seam 14 or form no compound layer in this area. Cover foil 8 has only one plastic foil 12 in the shown example.

Data sheet 3 is thus sewn into book-shaped identification document 1 via single plastic foils 10, 11 and 12.

The data sheet can alternatively be formed as a double page so that not only an edge area of foils 10, 11 and 12 becomes visible in the back area of identification document 1 but a total further document page arises which can likewise be inscribed. This personalized page would thus be constructed symmetrically with respect to seam 14 shown in FIG. 2. Here, too, the cover foils are designed so as to form no compound in the area of the seam. The inlay layer can likewise have a format corresponding exactly to that of the cover foils, so that no edge welding around the data sheet arises. In this case one must make sure not only that the plastic foils of the cover foils do not stick together but also that there is no adhesion to the material of the inlay.

Figure 3:
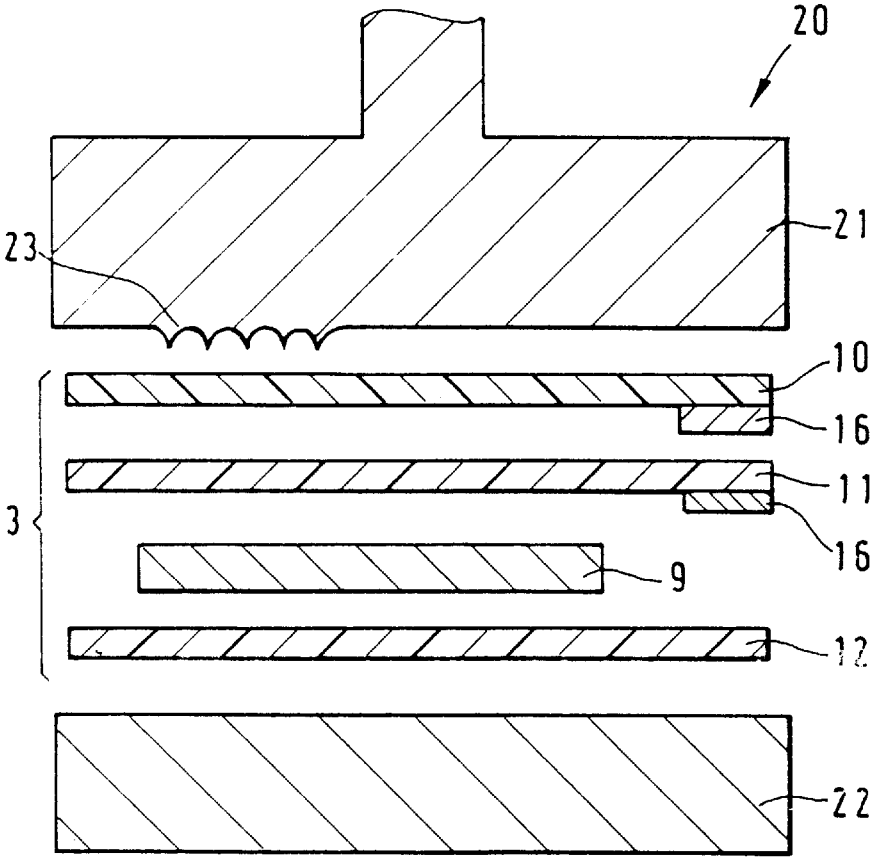
FIG. 3 shows a section through a laminating apparatus for producing a laminated data sheet according to FIG. 2.

FIG. 3 shows schematically the laminating process of data sheet 3, as shown in FIG. 2. Here, the single layers of data sheet 3, i.e. plastic foil 12, inlay 9 and plastic foils 11 and 10, are disposed above each other. Plastic foils 10, 11 and 12 were previously printed on opposing surfaces with separation layer 16 which ensures that plastic foils 10, 11 and 12 form no compound in this area during the laminating process. This layer structure is inserted into laminating apparatus 20 consisting of two laminating plates 21 and 22. Laminating plate 21 has in its surface the negative relief corresponding to relief structure 13. Under the action of heat and pressure the layer structure is then connected into a laminate, the foil structure being retained only in the areas provided with separation layers 16, i.e. foils 10, 11 and 12 are still present as single foils.

Figure 4:
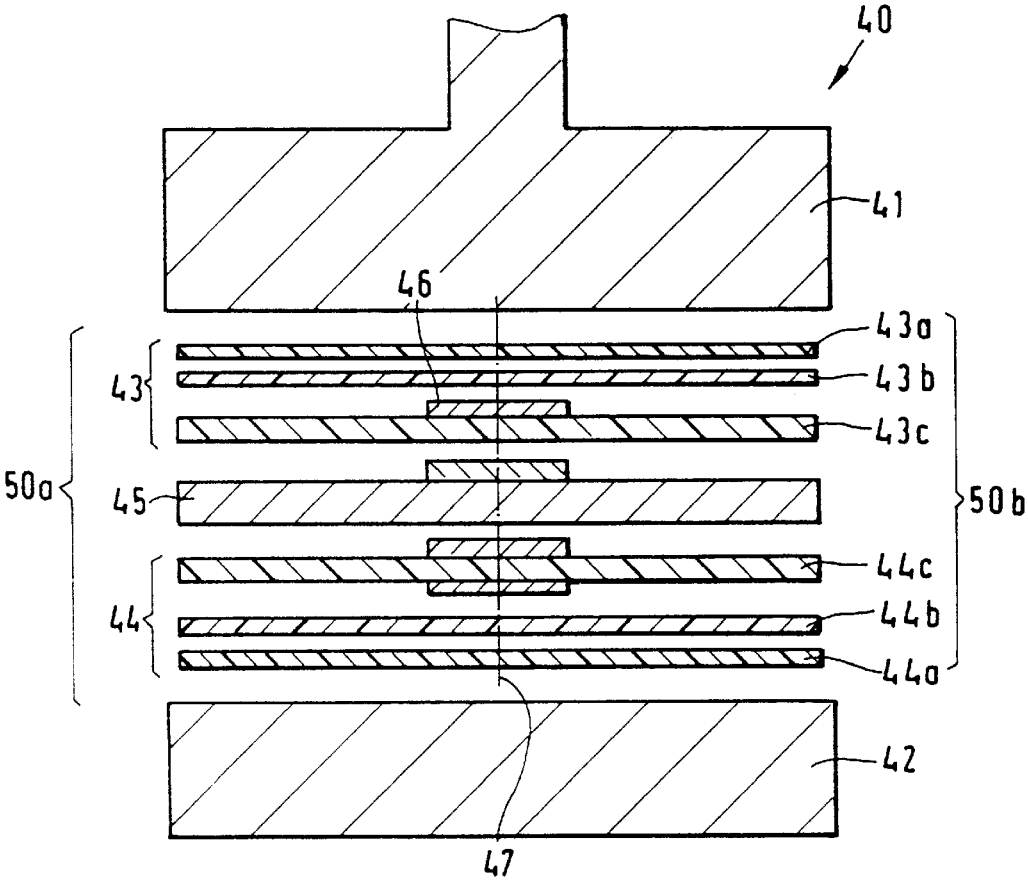
FIG. 4 shows a section through a laminating apparatus for producing a further embodiment of a laminated data sheet.

FIG. 4 likewise shows the principle of laminating apparatus 40 in cross section. Here, too, laminating apparatus 40 consists in principle of two laminating plates 41 and 42, the laminating plates shown in FIG. 4 having no surface structures so that the finished data sheet likewise has no surface structures, such as the lens structure shown in FIG. 2, but has completely plane surfaces. Between laminating plates 41, 42 the layer structure of a further embodiment of the data sheet is shown in an exploded view. This variant has the format of a double page of the finished identification document according to FIG. 1, so that the identification document containing the data sheet according to FIG. 4 has no edge area 35, as shown in FIG. 1. Instead, a complete personalized page is likewise located in the back area of the passport, said page having the same layer structure as the personalized page located in the front part of the identification document. The two personalized pages or data sheets are designated with reference signs 50*a* and 50*b* in FIG. 4. In the middle of the layer structure shown in FIG. 4 later seam 47 is indicated by a dash-dotted line. Accordingly, separation layers 46 are also disposed in the middle area of the layer structure. In the present example, however, not all layers were provided with a separation layer. Layers 43*a* and 43*b* and 44*a* and 44*b* have no such separation layer 46 so that they will also form an inseparable compound in the area of seam 47 after the laminating process. The other layers 43*c*, 44*c* and 45 were provided with separation layer 46 either on one side or on both sides in order to ensure that no adhesion to the adjacent layers arises during the laminating process.

The layer structure of data sheets 50*a*, 50*b* shown in FIG. 4 is symmetrical with respect to inlay 45, i.e. cover layers 43, 44 have the same number of foil layers and e same foil thickness. In addition, inlay layer 45 has the same format as cover foils 43, 44 in the shown example.

The inventive passport book has the advantage that the stiffness of the laminated page is greatly reduced by the more flexible single foils in the area of the seam, so that the passport book bursts open much less than known passport books. One can further reduce this bursting open of the passport book in the area of the laminated page, however, by subjecting the seam to additional measures.

Figure 5:
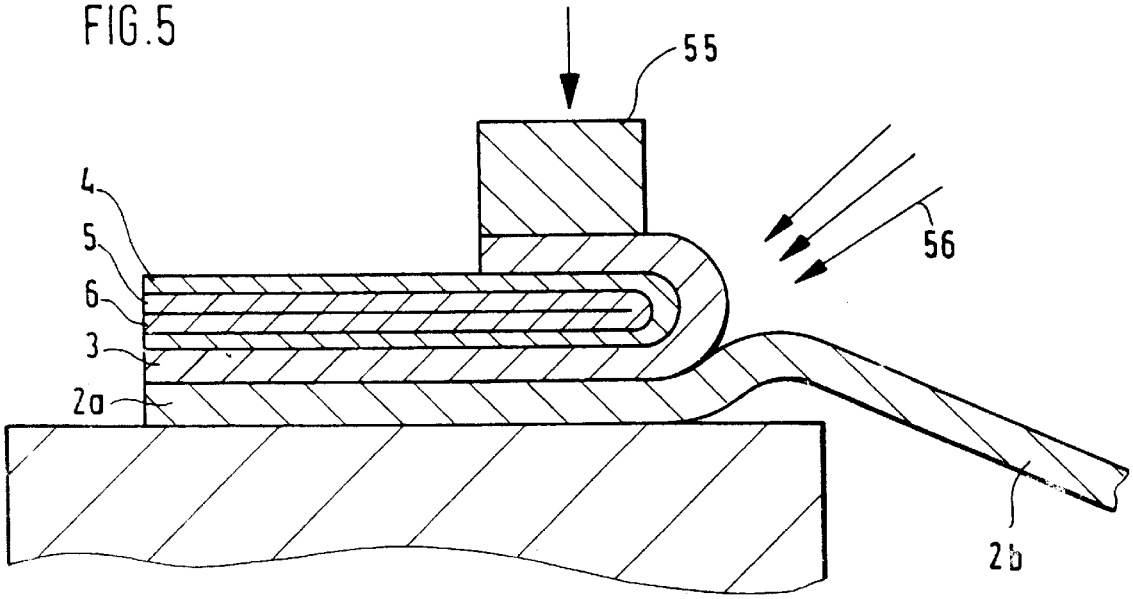
FIG. 5 shows a schematic representation of an additional heat treatment in the seam area.

FIG. 5 shows schematically a possibility for such additional treatment of the seam. In the shown case, a heat treatment of the seam is performed on the completely sewn passport. Back cover 2*b* is swung away and projecting foil pages 35 are bent around the sewn-in paper pages and held in this position by pressure element 55. The area of the seam is now heated and the thermoplastic foils thereby deformed, as indicated by arrows 56 in FIG. 5. Heating can be done for example by means of a hot air blower. The temperature necessary for deformation is in the range of about 100 to 150° C. depending on the foil material used. Heat exposure takes place only for a short time period, for example up to 5 sec. The passport is then held in the same position, the pressing power possibly increased somewhat, and the thermoplastic material cooled in air. Pressure element 55 is then removed and the passport supplied to any further processing steps.

According to an alternative method, the laminated passport page can also be bent accordingly before sewing. A further possibility is to cut back single foils to an extent such that the remaining foils fan less and the passport cover is thus no longer pressed away.

The present invention is by no means restricted to the above-described preferred embodiments, but covers all variations that might be implemented by using equivalent functional elements or devices that would be apparent to a person skilled in the art, or modifications that fall within the spirit and scope of the appended claims.

What is claimed is:

1. An identification document, comprising a plurality of sheets which are bound into a book at a seam, at least one sheet forming a data sheet provided with information and comprising at least two layers, at least one of the layers being transparent and the format of the layers being selected so that they protrude beyond the area of the seam thereby ensuring a connection of the data sheet with the other sheets of the identification document in the area of the seam, wherein the layers are connected into an inseparable laminate in the area of the information but do not stick together in the area of the seam.

2. The identification document of claim 1, wherein one of the layers consists of paper or plastic and another one of the layers is a transparent plastic foil.

3. The identification document of claim 1, wherein the two layers consist of transparent plastic foils which are connected with an inlay layer at least partly into a laminate.

4. The identification document of claim 3, wherein the transparent plastic foils are disposed on the same surface of the inlay layer and form a cover foil.

5. The identification document of claim 4, wherein the cover foil comprises further plastic layers, some of the plastic foils and optionally the inlay layer being connected into a laminate in the area of the seam.

6. The identification document of claim 4, wherein the format of the cover foil corresponds to the format of a double page of the identification document and the seam is disposed in the middle of said double page.

7. The identification document of claim 4, wherein the format of the inlay layer corresponds to or is smaller than the format of the cover foil.

8. The identification document of claim 4, wherein the inlay layer is provided with a cover foil on both sides.

9. The identification document of claim 4, wherein the inlay layer consists of paper or an opaque plastic foil.

10. The identification document of claim 3, wherein the plastic foils consist of different plastic materials and contain different additives.

11. The identification document of claim 3, wherein the plastic foils are selected from the group consisting of polycarbonate (PC), glycol modified polyethyleneterephthalate (PETG) and high deflection temperature (HDT).

12. The identification of claim 1, wherein the seam is formed by a sewn-in thread or gluing.

13. The identification document of claim 1, wherein the data sheet has user-related data which are incorporated by a laser.

14. A method for producing an identification document, comprising:

providing a plurality of sheets including at least one data sheet comprising at least two layers;

providing an information area on the data sheet;

connecting the two layers into an inseparable laminate in the information area;

providing a seam area in the at least one data sheet in which the layers are not connected; and binding the sheets into a book at the seam area.

15. The method of claim 14, wherein the step of connecting the two layers into an inseparable laminate comprises laminating the layers under heat and pressure.

16. The method of claim 15, wherein the layers comprise plastic foils and the step of providing a plurality of sheets further comprises providing a separation layer between the plastic foils in the seam area to prevent the connection of the layers in the seam area during lamination.

17. The method of claim 16, wherein the step of providing the separation layer between the plastic foils in the seam area comprises applying the separation layer by a printing process.

18. The method of claim 14, further comprises subjecting the data sheet to additional measures in the seam area to prevent the identification document from easily unfolding by itself.

19. The method of claim 18, wherein the step of subjecting the data sheet to additional measures comprises deforming the data sheet in the seam area by heat action such that the layers of the data sheet cling to the other sheets that are bound to the identification document.

20. The method of claim 18, further comprising deforming the data sheet thermoplastically before the step of binding the sheets into a book such that during the binding step the data sheet clings in the seam area to the other sheets that are also bound in the seam area.

21. The method of claim 18, wherein the data sheet has a format exceeding the document format in size such that the layers of the data sheet form protrusions that protrude beyond the seam area and further comprising the step of trimming the protrusions to prevent the book from easily unfolding by itself.

22. The identification document of claim 8, wherein the coverfoils have different thickness.

23. The identification document of claim 10, further comprising a lens field having a surface area and lenses, the lenses having a focal plane and disposed in the surface area, the surface area configured to minimally absorb laser radiation, and one of the layers arranged in the focal plane of the lenses and configured to absorb high amounts of laser radiation.

24. The method of claim 14, wherein the step of connecting the layers in to an inseparable laminate comprises laminating the information area without laminating the seam area.

25. The method of claim 14, wherein the step of providing information comprises inscribing into the inseparable laminate with a laser.

26. The method of claim 25, wherein the layers comprise plastic foils including a cover foil and the step of inscribing into the inseparable laminate with a laser comprises causing the laser to form a perceptible microrelief on the surface of the cover foil.

27. The method of claim 17, wherein the printing process is selected from the group consisting of screen printing and offset printing.

28. The identification document of claim 3, wherein the plastic foils consist of different plastic materials or contain different additives.

* * * * *